US007854568B2

(12) United States Patent
Ekuan et al.

(10) Patent No.: US 7,854,568 B2
(45) Date of Patent: Dec. 21, 2010

(54) DIVING EQUIPMENT

(75) Inventors: Shoji Ekuan, Tokyo (JP); Masayuki Kurokawa, Tokyo (JP); Atsushi Tashiro, Tokyo (JP)

(73) Assignee: Nihon University, Tokyo (JP)

( * ) Notice: Subject to any disclaimer, the term of this patent is extended or adjusted under 35 U.S.C. 154(b) by 85 days.

(21) Appl. No.: 12/281,204

(22) PCT Filed: Feb. 15, 2007

(86) PCT No.: PCT/JP2007/052674

§ 371 (c)(1),
(2), (4) Date: Oct. 22, 2008

(87) PCT Pub. No.: WO2007/099771

PCT Pub. Date: Sep. 7, 2007

(65) Prior Publication Data

US 2010/0003083 A1 Jan. 7, 2010

(30) Foreign Application Priority Data

Mar. 1, 2006 (JP) ..... 2006-054382

(51) Int. Cl.
*B63C 11/10* (2006.01)

(52) U.S. Cl. ..... 405/187; 405/186; 441/111; 441/118

(58) Field of Classification Search ..... 405/185, 405/186, 187; 441/114, 115, 116, 117, 118, 441/111, 106, 123
See application file for complete search history.

(56) References Cited

U.S. PATENT DOCUMENTS 3,415,211 A * 12/1968 Hampton ..... 405/186
3,436,777 A * 4/1969 Greenwood ..... 405/186
4,009,583 A * 3/1977 Buckle ..... 405/186
4,324,507 A * 4/1982 Harrah ..... 405/186
4,601,609 A * 7/1986 Hyde ..... 405/186
4,752,263 A * 6/1988 Pritchard et al. ..... 405/186

(Continued)

FOREIGN PATENT DOCUMENTS

EP 1 116 649 A2 7/2001

(Continued)

OTHER PUBLICATIONS

International Search Report for International Application No. PCT/JP2007/052674 dated May 1, 2007.

*Primary Examiner*—Frederick L Lagman
(74) *Attorney, Agent, or Firm*—Kratz, Quintos & Hanson, LLP

(57) ABSTRACT

Diving equipment easily operable by disabled persons, aged persons, etc. and wearable by oneself. The diving equipment such as buoyancy controlling device (BCD) has the function to hold a tank on the shoulder of a wearer and the function as a life jacket providing buoyancy to the wearer. In the diving equipment (BCD) of which the overall is formed in a vest-like shape, a tank holding part (2), shoulder parts (3) positioned at the both shoulder portions of a diver, and the portion (4) positioned at the center of the thoracabdominal part of the diver are formed continuously to each other so as to constitute rigid structural members. Most or all operating portions (5) are installed at the portion (4) positioned at the center of the thoracoabdominal part of the diver.

6 Claims, 8 Drawing Sheets

U.S. PATENT DOCUMENTS

| | | | | |
|---|---|---|---|---|
| 5,295,765 | A * | 3/1994 | Choi | 405/186 |
| 6,287,053 | B1 * | 9/2001 | Garofalo et al. | 405/186 |
| 6,659,689 | B1 * | 12/2003 | Courtney et al. | 405/186 |
| 6,749,369 | B2 * | 6/2004 | Garofalo | 405/186 |
| 6,805,519 | B1 * | 10/2004 | Courtney | 405/185 |
| 2001/0029951 | A1 | 10/2001 | Miklos | |
| 2005/0075018 | A1 | 4/2005 | Urabe | |
| 2005/0123357 | A1 * | 6/2005 | Canella | 405/186 |
| 2005/0191135 | A1 * | 9/2005 | De Felice | 405/186 |
| 2006/0120808 | A1 * | 6/2006 | Roseborough | 405/186 |

FOREIGN PATENT DOCUMENTS

| | | | |
|---|---|---|---|
| JP | 2001-270492 | A1 | 10/2001 |
| JP | 2002-234489 | A1 | 8/2002 |
| JP | 2005-112153 | A1 | 4/2005 |

* cited by examiner

DIVING EQUIPMENT

TECHNICAL FIELD

The present invention relates to diving equipment that a diver wears when diving. More particularly, the present invention relates to diving equipment (hereafter, referred to as 'BCD') that a diver wears when diving, which has function to hold a tank filled with air for diving on the shoulder of the wearer and function as a life jacket providing buoyancy to the wearer, and is formed in a vest shape.

BACKGROUND ART

Recently, the amount of people enjoying scuba diving has increased along with an increase in the popularity of the sports and the diversification of leisure. Further, a variety of disabled persons are also scuba diving.

However, the BCD for scuba diving is made on the basis of the normal use of a physically capable person. Consequently, this is inconvenient for a disabled individual using the BCD having the configuration.

For example, an oral inflator hose, a gauge, and an octopus are disposed at the left side of the body, while a regulator is disposed at the right side of the body. That is, the operating part is divided to the left and right sides.

However, it is difficult for people who may have problems on the lateral half of the body to operate the operating part that is divided into left and right sides of the jacket.

Further, according to the BCD in the related art, for intake and exhaust, the intake is made by operating a button and the exhaust is made by pushing an exhaust button, with an exhaust hose positioned upward, and discharging the air in the BCD or pulling an exhaust rope.

However, since the intake and exhaust are made by operating the buttons and the buttons for the intake and exhaust are commonly provided to the left side, people who have a weak grip, aged persons, people with paralyzed hands, people having problems with joints, and people who are disabled on the left side have difficulty in operating the desired buttons, which has an adverse effect on the intake and exhaust.

Further, the regulators in the related art extend outward from the tank at the back of the body, through a pressure-resistant hose and a first stage.

However, since the regulator extends from the tank at the back of the body, if the regulator is separated from the mouth, recovery is difficult (it is difficult to return the regulator because the regulator is pulled back behind the diver). Therefore, a very dangerous situation may occur, particularly, for divers whose hands are paralyzed, people paralyzed on the right side of the body, and divers who cannot freely move their arms.

The BCD in the related art has an airbag, substantially formed in an H-shape, at the rear side and maintains the balance and neutral buoyancy by adjusting the amount of air in the airbag and the amount of air in the lung.

For people who are paraplegic on a half of the body, it has been known that the buoyancy is large at the paralyzed side.

However, as the paralyzed half of the body moves upward (rises) in water, the air in the airbag also moves upward, that is, to the paralyzed side, such that the buoyancy at the paralyzed side increases and balance correspondingly changes.

In the related art, in order to this problem, a weight is added to the side where the buoyancy increases (the paralyzed side) to offset the increased buoyancy such that balance is recovered. However, according to this method, if the diver dives with heavy weights (overweight), this imposes a large burden on the diver.

Further, the BCD in the related art is commonly made from special nylon fiber.

However, it is difficult for a person to put on the BCD by oneself because the nylon fiber of the BDC in the related art is soft and the shape is not fixed.

Further, in the BCD according to the related art, an octopus is accommodated in a pocket or retained by an optional holder and a gauge may also be retained by a holder or hung down.

However, buying optional holders for the gauge and octopus may be a burden to diving lovers. On the other hand, when the gauge and the hose of the octopus are accommodated in the pocket of the BCD or hung down, a diver having problems on the arms may have difficulty in checking the amount of air in the tank through the gauge or handle the octopus in an emergency.

A user using a wheelchair may enter the sea, with sitting on his/her wheelchair without the equipment, such as the air tank, and then attach equipment with other's help on the surface of the water. This is because the tank interferes with the back of the wheelchair when the user is equipped with the BCD having a tank in the related art.

However, it is very difficult to attach and detach the equipment on the surface of the water while being shaken by the wave.

Diving is usually made by a group of two people (a pair). Further, when one of the pair loses consciousness due to a problem, the other rescues the person having a problem, basically facing the person.

If the person is unconscious, they should rise to the surface as fast as possible, in which the rescuer generally rise to the surface, holding the person (the rescued-person).

However, when rising while holding the unconscious person (rescued-person), both of the rescuer's hands are occupied, such that it is difficult for the rescuer to put air into his/her BCD or the BCD of the rescued-person, or make the BCD ready on the surface of water.

Further, in the BCD according to the related art, a pressure resistant hose that is connected extends from the back, that is, the end of the tank. Accordingly, it is difficult to handle the pressure resistant hose, such as in recovery and usual time.

As another related art, a technology that integrally attaches a hand expansion life jacket to a portion of a diving suit has been disclosed (see Patent Document 1).

However, the above-mentioned related art relates to a mechanism that generates buoyancy by filling with air, but cannot overcome the above problem, particularly various problems that appear when the disabled persons dive.

Patent Document: Japanese Patent Application Laid-Open Publication No. 2002-234489

The present invention has been proposed in consideration of the problems in the related art and an object of the present invention is to provide diving equipment that allows the disabled persons, aged persons, etc. to put on, take off, and easily do the desired operations by themselves.

BRIEF SUMMARY OF THE INVENTION

Diving equipment BCD of the invention has a function to hold a tank filled with compressed air on the shoulder of a wearer and function as a life jacket providing buoyancy to the wearer, and is formed in a vest shape, in which a tank holding part (2), shoulders portions(3) that are divide into two portions on the shoulders of the diver, and a portion (4)positioned at the center of the diver's thoracoabdominal part are formed continuously to each other. Further, a structural member having rigidity is provided and an operating portion (5) (most or all) is positioned at the center of the diver's thoracoabdominal part (4).

In the present invention, it is preferable that the operating portion (5) is a lever-shape member (intake lever 6 and exhaust lever 7 having lever portions 61, 71) that is movable to the left/right (in the directions of arrow R1 and arrow R2) and downward (along the center line of the diver) (in the direction of arrow V).

Further, in the present invention, it is preferable that pressure resistant hoses (H8, H9, H6) through which air flows from the tank (T) extend forward from the portion (4) positioned at the center of the diver's thoracoabdominal part.

In the present invention, it is preferable that regions (airbags 8L, 8R) where air stays are provided at the left and right sides of the rigid structural member (tank holding part 2, shoulders portions 3 that are divide into two portions on the shoulders of the diver, and a portion 4 positioned at the center of the diver's thoracoabdominal part) and the regions (airbags 8L, 8R) are independently formed.

In this configuration, it is preferable that the regions (airbags 8L, 8R) where the air stays extend to cover the rear side and sides of the diver's femoral region.

Further, in the present invention, it is preferable that a holding portion (holder 41) that engages (locks and holds) the pressure hoses (H8, H9, H6) through which the air flows from the tank is formed at the portion (4) positioned at the center of the diver's thoracoabdominal part.

In the present invention, it is preferable that a handle (9) that is made of a rigid material is provided to the tank holding part (2).

In the present invention, it is preferable that the pressure resistant hoses H1 to H4 through which the air flows from the tank (T) are connected with the inside of the handle (9) through a first stage (10), and extend forward from the diver's thoracoabdominal part through the inner space of the tank holding part (2), the inner space of the shoulder parts (3), which are divided into two portions, and the inner space of the portion (4) positioned at the center of the diver's thoracoabdominal part.

In this configuration, it is preferable that all of the pressure resistant hoses H1 to H4 that extend from the first stage 10 are tied through the inside of the handle 9.

In the present invention, it is preferable that the tank holding part (2) (of which the whole (longitudinal) length is relatively small) forms a gap between the tank and the diving equipment when holding the tank (T).

Further, since the airbags 8L, 8R extend to cover the side of the femoral region of the body, as compared with a BCD in the related art, which is disposed over the waist, it is easy to maintain the appropriate horizontal position of the entire body of the diver for diving, that is, both shoulders are horizontal when seen above the head.

According to the present invention having the above configuration, the following effects can be obtained.

(1) Since the operating portion (5) is concentrated to the chest (or thoracoabdominal-part), a person with an arm paralyzed can also operate the operating portion.

(2) Since the operating portion (5) is provided with the lever-shaped members (6, 7) and the intake and exhaust can be made by operating the levers, a diver with a weak grip or a diver with the part from the wrist to the fingertip removed can also easily do desired operations.

(3) Since the hoses (H8, H9, H6) through which the air flows from the tank (T) and their fixed ends are concentrated to the chest (or thoracoabdominal part), even if the devices (e.g. regulator, octopus, gauge, etc.) do not fit to the mouth or the holder, they are not moved to the back of the diver and it is possible to return them by pulling the fixed ends of the hoses (H8, H9, H6).

(4) When the regions where the air stays are provided to the left and right sides of the structural member (60) such that the regions (8) are independent at the left and right sides, the buoyancy of the left and right sides can be easily balanced by operating the lever-shaped members (6, 7) to adjust the amount of air in the regions (airbags 8L, 8R). Therefore, it is not required to additionally provide a weight, thereby improving mobility and increasing safety.

(5) Since the structural member 60 has high rigidity and a stable shape, a diver can easily put on the structural member from above, such that a person can put it on by oneself. Further, the disabled persons can put it on by oneself, depending on degree of trouble, which becomes a first step of independence of the disabled persons.

(6) Since all of the fixed ends of the hoses (H8, H9, H6, H21, H22) are concentrated to the chest thoracoabdominal part), they can be easily used. Further, the wearer can obtain the sense of security even if the devices at the ends of the hoses are carried away, by pulling the hoses.

(7) By making the tank holding part (2) short such that the lower end does not interfere with the back of a wheelchair, a user can sit on the wheelchair on the land, with the equipment (100) on his/her back. Therefore, the user can dive after putting on the equipment (100) on the land, such that not only the user can lessen a burden of himself/herself, but the supporter can lessen a burden. (8) By providing the handle (9) that is made of a rigid material to the tank holding part (2), for example, even if one of a pair of divers has a trouble such that he/she loses consciousness, the other diver can easily rise to the surface of water, holding the handle (9) of the unconscious diver from the back with one hand.

(9) By providing holding portions (hose holders 41) that are engaged with the pressure resistant hoses (H8, H9, H6) to the left and right sides of the tank holding part (2), it is possible to arrange the pressure resistant hoses (H8, H9, H6) such that they do not interfere with each other. Therefore, a person with paralysis can easily move in the water as well as on the land.

(10) By making the airbags cover the sides of the diver's femoral region, as compared with a BCD in the related art, which is disposed over the waist, it is easy to maintain the appropriate horizontal position of the entire body of the diver for diving.

EXPLANATION OF REFERENCE NUMERALS AND SYMBOL

Figure 1:
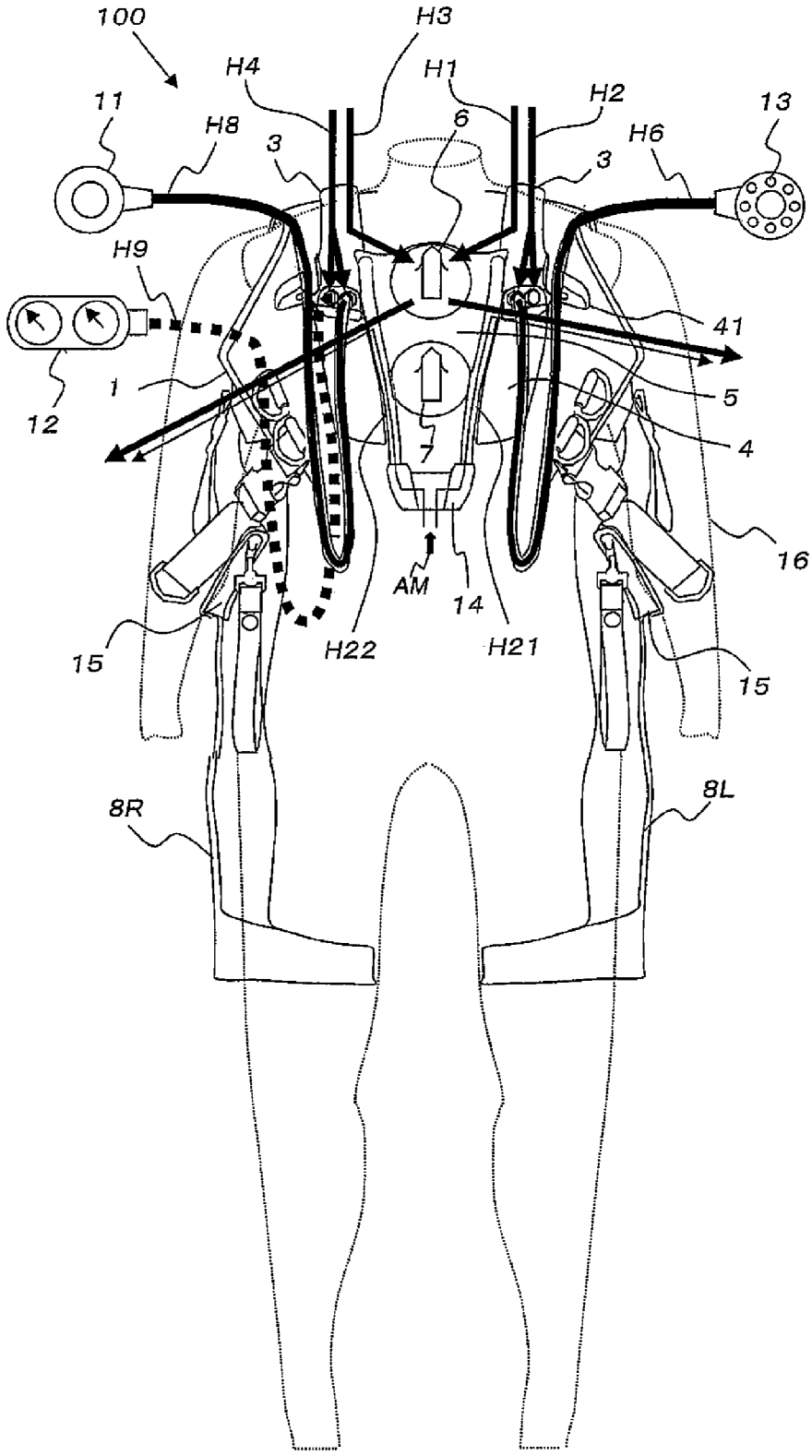
FIG. 1 is a front view according to an embodiment of the invention.

1: diving equipment/BCD
2: tank holding part
3: shoulder part
4: central thoracoabdominal part
5: operating portion
6: intake adjusting lever
7: exhaust adjusting lever
8: airbag
9: handle
10: first stage
11: regulator
12: gauge
13: octopus
14: oral inflator
15: weight bag
21: tank contact portion
22: tank holder
23: exhaust outlet
41: hose holder
T: tank

BEST MODE FOR CARRYING OUT THE INVENTION

Preferred embodiments of the invention are described hereafter with reference to the accompanying drawings.

Figure 2:
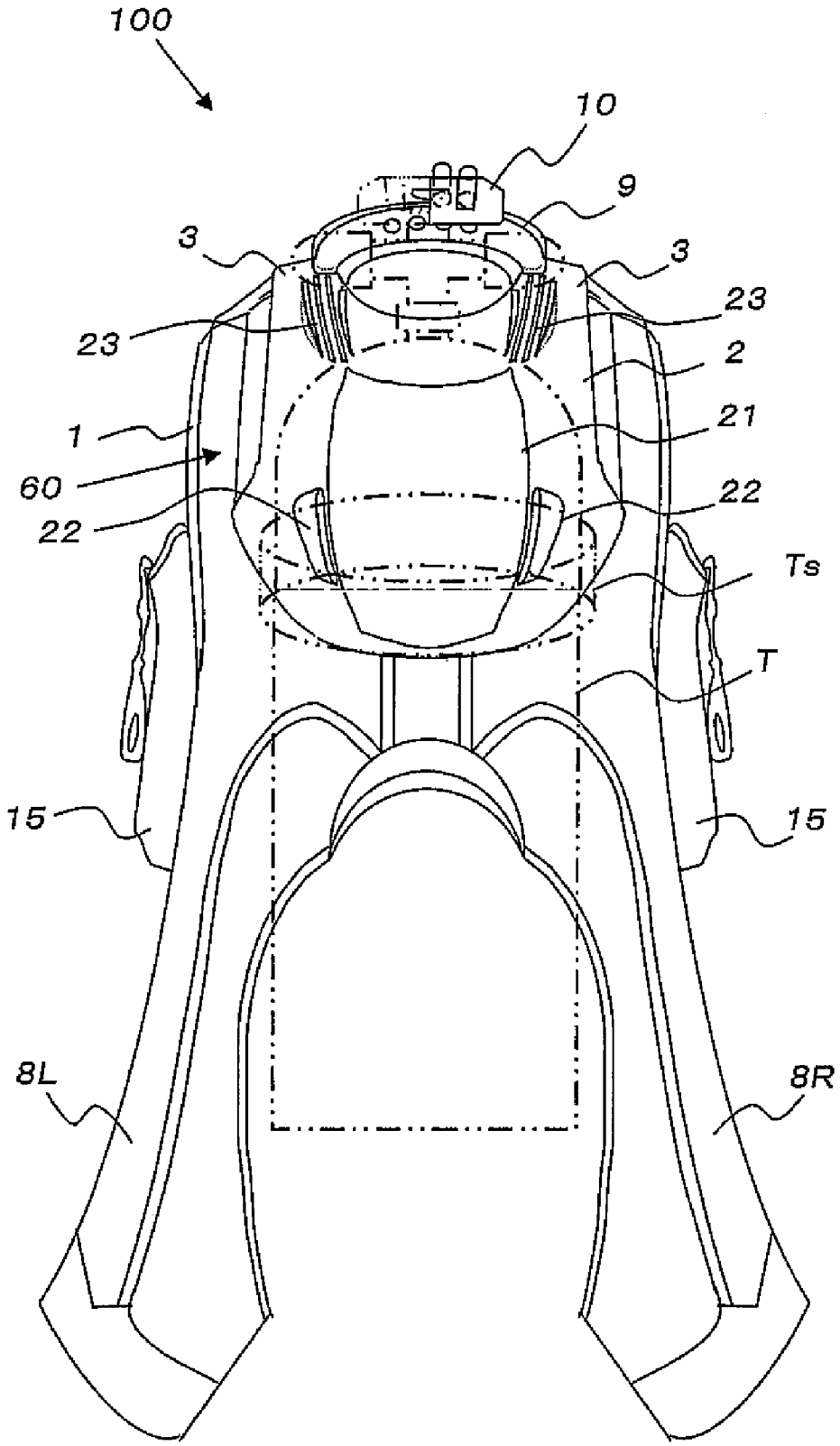
FIG. 2 is a rear view according to the embodiment of the invention.
Figure 3:
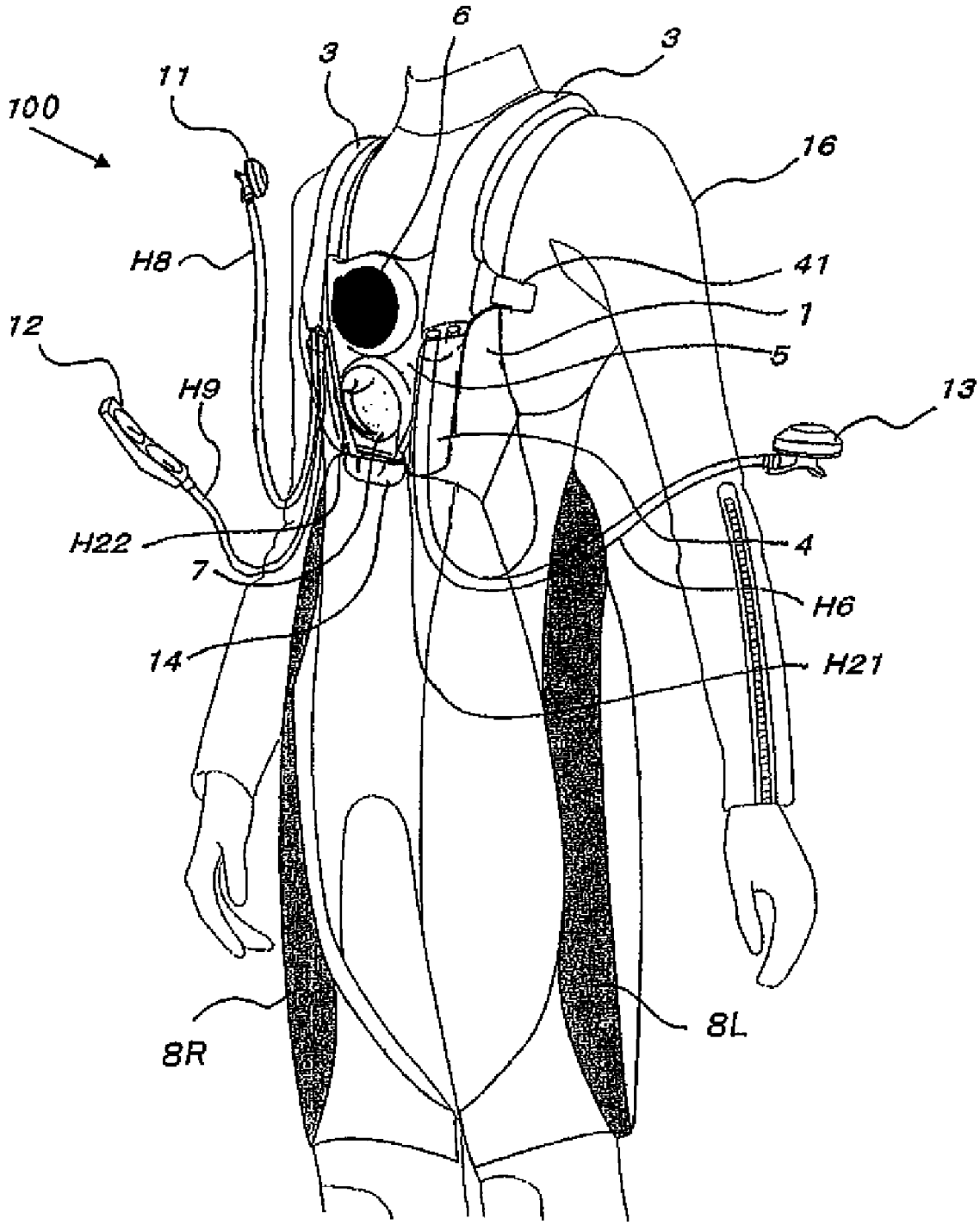
FIG. 3 is a perspective view of FIG. 1.
Figure 4:
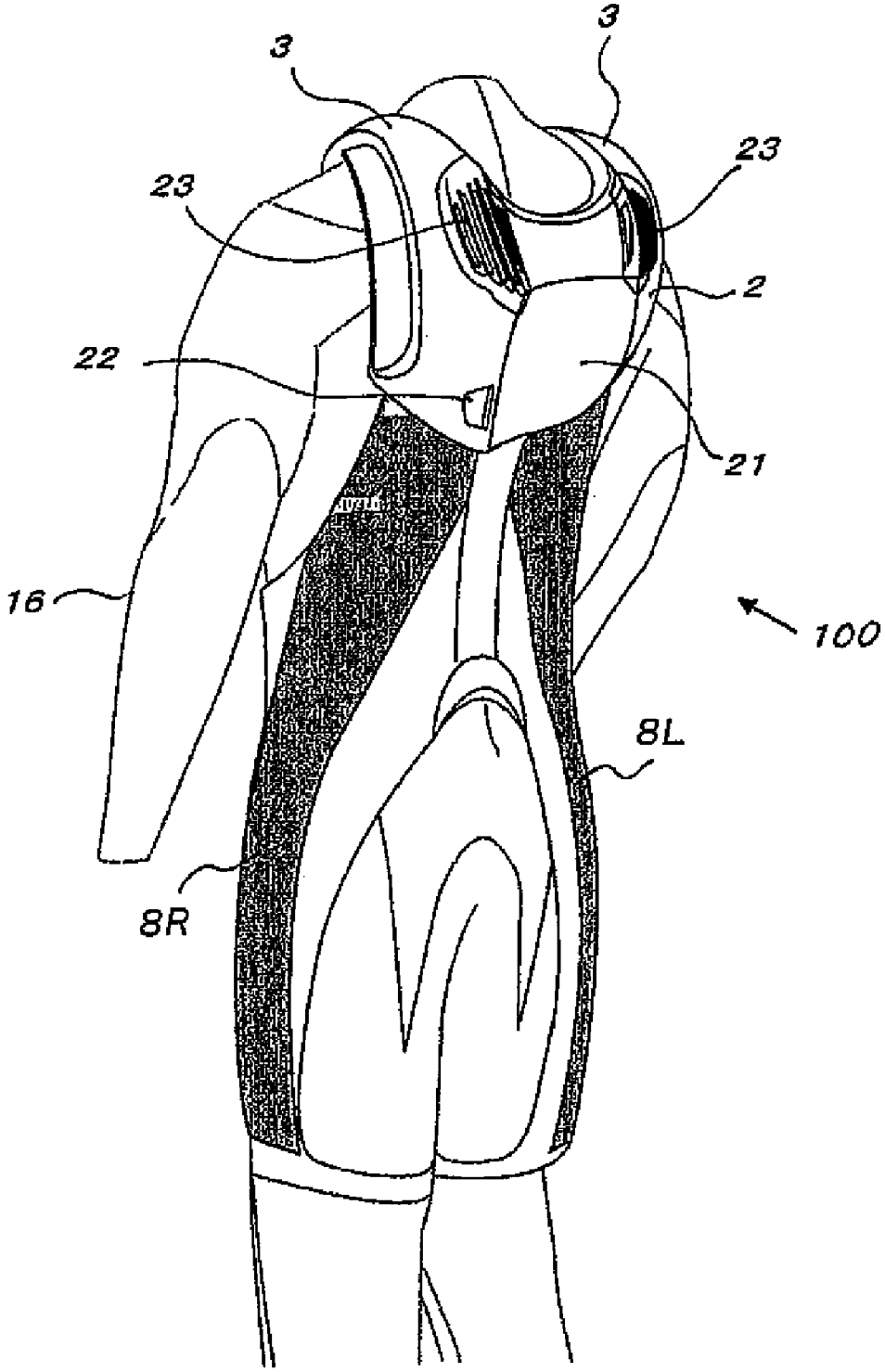
FIG. 4 is a perspective view of FIG. 2.

Diving equipment is indicated by a reference numeral '100' in FIGS. 1 to 4, FIG. 1 is a front view, FIG. 2 is a rear view, FIG. 3 is a perspective front view, and FIG. 4 is a perspective rear view.

The diving equipment 100 includes a vest part 1 and a pair of pouches (air bags) 8L, 8R as shown in FIGS. 1 and 3.

The vest part 1 is a member that covers the part of the body from the neck to the waist (thoracoabdominal part and back) and has substantially the same shape as a vest, clothes, except for the opening of the thoracoabdominal part. Further, the vest part 1 is made of synthetic resin or other fibers and has sufficient plasticity.

The air bags 8L, 8R are connected with each other at the left and right sides of the vest part 1 and extend downward from the left and right sides of the vest part 1. In other words, in the embodiment shown in FIGS. 1 and 2, the airbags 8L, 8R extend to cover the sides of the diver's femoral region. Further, the lower ends of the airbags 8L, 8R are attachable to the diver's femoral region by belts.

As shown in FIGS. 2 and 4, the diving equipment 100 has a tank holding part 2, shoulder parts 3, and thoracoabdominal part 4 (see FIG. 1). The tank holding part 2, the shoulder parts 3, and thoracoabdominal part 4 are continuously formed, and entirely form a rigid structural member (function-integrated member). The entire rigid structural member or the function-integrated member is indicated by a reference numeral '60' and has an integrated intake/exhaust function.

The tank holding part 2 is formed to cover the back of the vest part 1.

The shoulder parts 3 are formed to cover both shoulders of the diver in the vest part 1 (or both shoulders of a human body), divided into two portions at the upper portion of the tank holding part 2.

Thoracoabdominal part 4 covers the front region of the vest part 1, positioned to the center portion of the thoracoabdominal part of a human body (diver).

Figure 5:
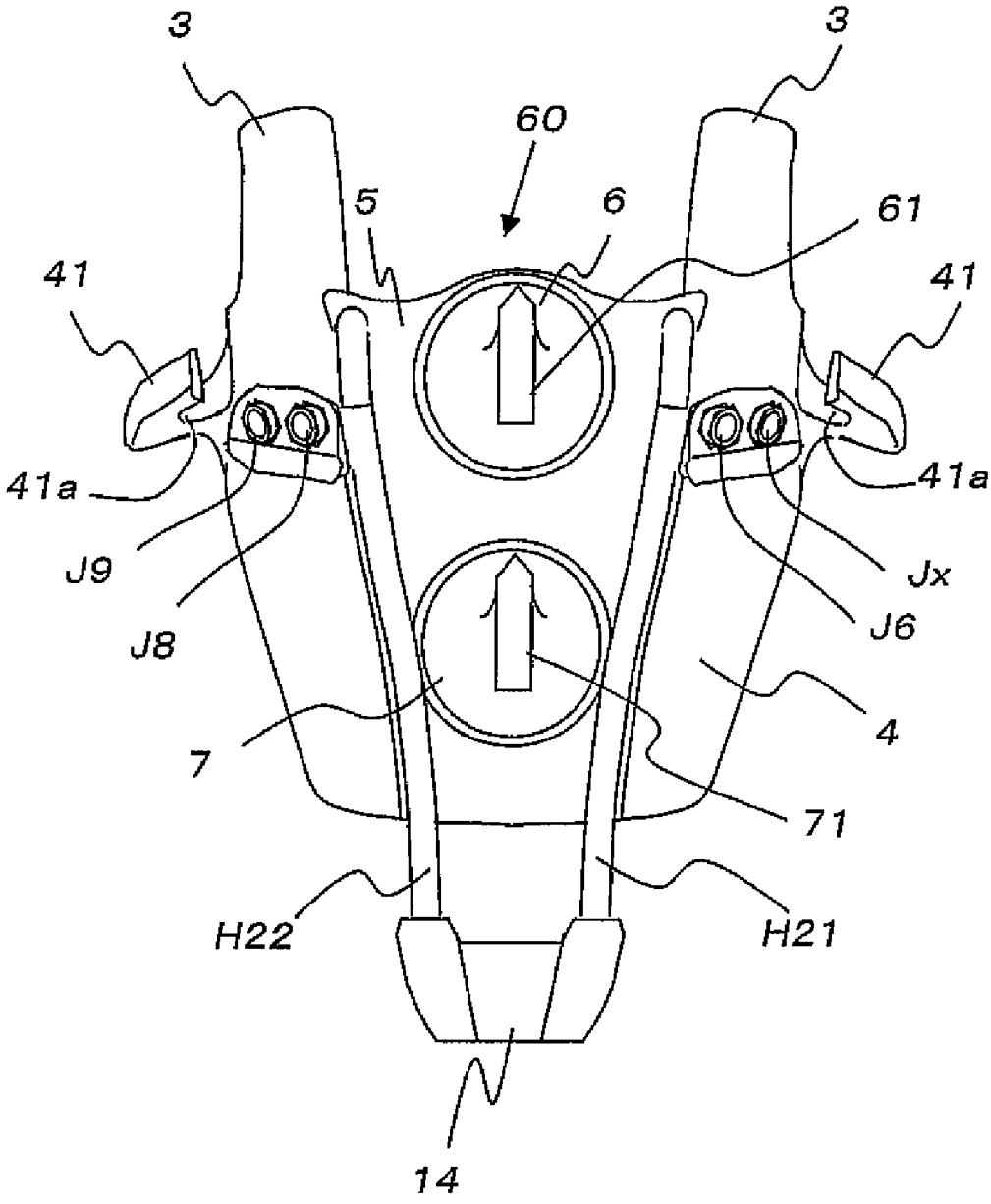
FIG. 5 is a front view of a function-integrated portion according to the embodiment of the invention.

In FIG. 5, an operating portion 5 is provided at the center of thoracoabdominal part 4 of the function-integrated member 60. The operating portion 5 is provided with an intake lever 6 and an exhaust lever 7.

The intake lever 6 is a member adjusting the amount of intake air from the air tank T (indicated by a two-dotted line in FIG. 2) to the airbags 8L, 8R and disposed over the operating portion 5. The exhaust lever 7 is a member adjusting the amount of exhaust air of the left and right airbags 8L, 8R and disposed under the operating portion 5.

The intake lever 6 and exhaust lever 7 will be described in detail with reference to FIGS. 8 to 10.

In FIG. 5, caps jx, J6, J8, J9 are provided at the left and right sides of thoracoabdominal part 4. The caps Jx, J6, J8, J9, caps for connecting pressure resistant hoses, which is described below, are disposed in two positions at each of the left and right sides, that is, a total of four positions.

In detail, in FIG. 5, the caps J8, J9 are disposed at the left side of the thoracoabdominal part 4, in which the cap J8 is a cap for connecting a hose H8 for a regulator (see FIG. 1) and the cap J9 is a cap for connecting a hose H9 for a gauge (see FIG. 1). The cap J8 is disposed inside in the left/right direction (adjacent to the center axis, which is not shown) from the cap J9 in FIG. 5.

Further, the caps J6, Jx are disposed at the right side of thoracoabdominal part 4 in FIG. 5. The cap J6 is a cap for connecting a hose H6 for an octopus (see FIG. 1) and the cap Jx is a cap for connecting an optional hose (not shown). Further, the cap J6 is disposed adjacent to the left/right directional center axis (inside) from the cap Jx in FIG. 5.

On the other hand, the regulator is a device through which a diver receives air into his/her mouth, taking it in his/her mouth, and the octopus is a regulator for rescue that is used when one of the pair of divers has a problem in the water.

In FIG. 5, hose holding members (hose holder) 41 are provided at the right side where the caps Jx, J6 are disposed and at the left side where the caps J8, J9 are disposed. In other words, a pair of left and right hose holders 41 is formed adjacent to the positions where the caps Jx, J6, J8, J9 are disposed, that is, the outer most sides in the left/right direction of FIG. 5.

The hose holders 41 are protrusions that protrude in a J-shape and the insides of the J-shaped curved portions (indicated by a reference numeral 41*a*) faces the left/right center of thoracoabdominal part 4.

Referring to FIG. 1, the curved inside 41*a* (connected to the cap J8) of the hose holder 41 formed at the left side of FIG. 5 holds the hose H8 for the regulator and the hose H9 for the gauge (connected to the cap J9).

On the other hand, the curved inside 41*a* of the hose holder 41 formed at the right side of FIG. 5 holds the hose H6 for the octopus (connected to the cap J6) and the hose for the optional hose (connected to the cap J9, not shown).

The caps J8, J9 are connected with the pressure resistant hose H4 extending from the air tank T and the caps J6, Jx are connected with the pressure resistant hose H2 extending from the air tank T.

The pressure resistant hose H4, H2 extending from the air tank T will be described with reference to FIG. 7.

Referring to FIG. 5, air hoses H21, H22 are connected to the left and right upper ends of the operating portion 5.

The air hoses H21, H22 hang down from the upper portion of the operating portion 5. Further, the ends of the air hoses H21, H22 are connected to the intake lever 6 and the other ends are connected to an oral inflator 14, such that as the diver exhales, the left and right airbags can be filled with air through the intake lever 6 (by exhaling).

The oral inflator 14 is a device for filling the airbags with air through the diver's mouth (exhaling: indicated by a reference character 'AM' in FIG. 1). For example, when standing by on a boat or on the surface of water before diving, the diver needs to supply air into the airbags to obtain buoyancy, but, in order to supply air into the airbags, the diver fills the airbags with air by exhaling using the oral inflator 14 without using the air in the air tank.

The rear side structure of the function-integrated member 60 is described with reference to FIGS. 2, 4, and 6.

Figure 6:
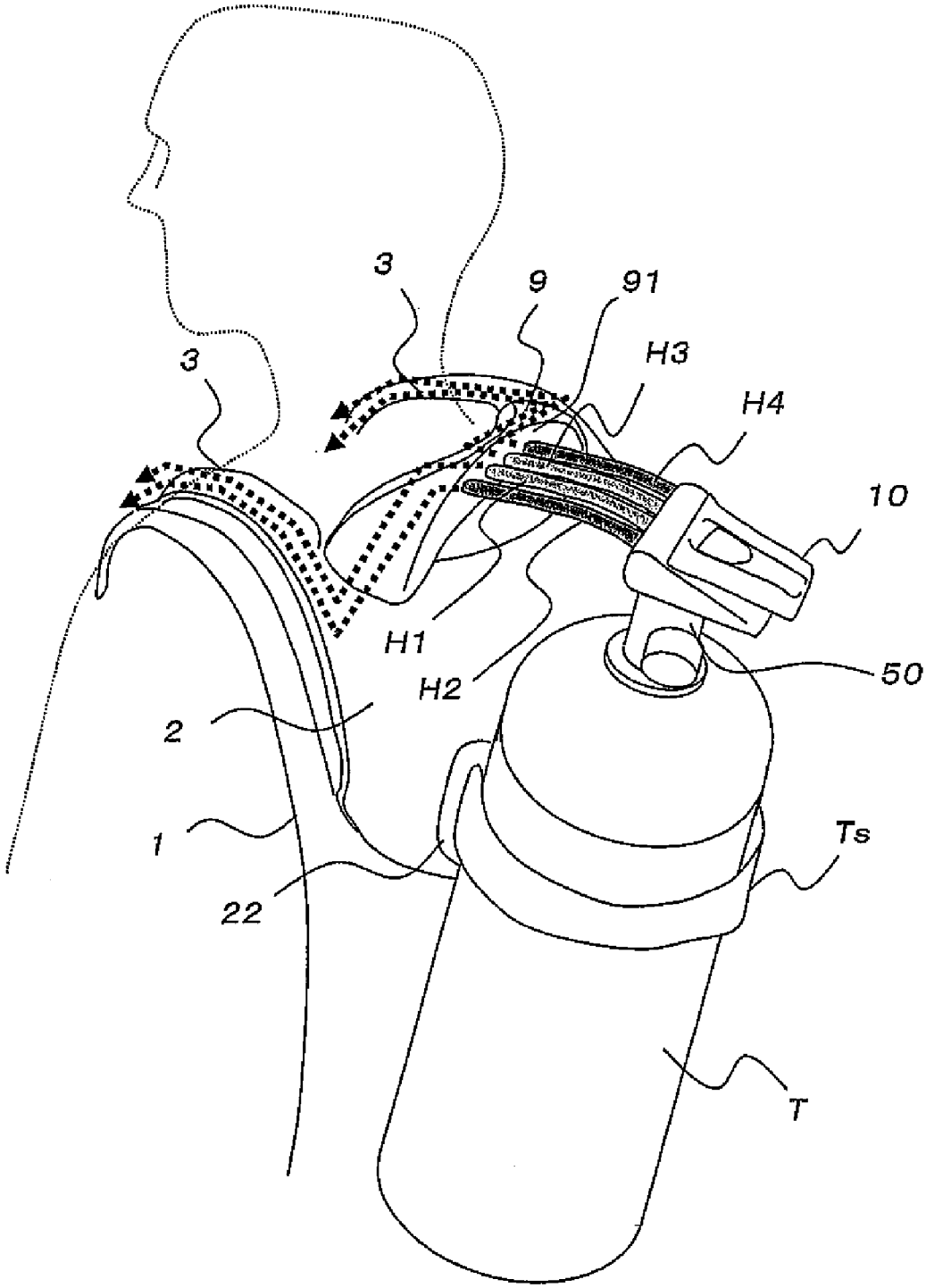
FIG. 6 is a perspective view illustrating arrangement around a tank connection attachment according to the embodiment of the invention.

In FIGS. 2, 4, and 6, most of the rear side of the function-integrated member 60 is occupied by the tank holding part 2.

The upper portion of the tank holding part 2 is divided into two portions and the divided portions form the shoulder parts 3 positioned on the diver's both shoulders.

The shoulder parts 3 are connected to thoracoabdominal part 4.

In FIGS. 2 and 4, a tank contact surface 21 is formed from the vertical center portion to the lower portion of the tank holding part 2.

The outside of the tank T contacts with the tank contact surface 21. Further, tank holders 22 are formed at both the left and right sides, slightly under the vertical center of the tank contact surface 21. The tank holders 22 are members that engage a tank strap Ts for holding the air tank T (see FIGS. 2 and 6).

The vertical length of the tank holding part 2 is small, for example, such that the lower end of the tank holding part 2 does not overlap the back of a wheelchair when a user sits on the wheelchair.

According to this configuration, for example, when a disabled person using a wheelchair scuba dives, the disabled person can sit in the wheelchair after putting on the equipment on land. That is, sitting on the wheelchair, the disabled person can move on land and dive to the sea.

In FIGS. 2 and 4, exhaust ports 23 are formed at both upper right and left sides of the tank contact surface 21. The exhaust ports 23 are provided to discharge air in the airbags 8L, 8R.

Though described below with reference to FIG. 7, the exhaust ports 23 are connected with the airbags 8L, 8R and the exhaust amount from the exhaust ports 23 is adjusted by the exhaust lever 7.

In the configuration shown in FIG. 6, an arc-shaped member 9 (handle) is provided at between the sides facing the tank holding part 2 of the shoulder parts 3. The handle 9 is made of a high-rigid material.

The high-pressure air hoses H1 to H4 are connected to the rear side 91 of the handle 9, in which the high-pressure air hoses H1 to H4 are connected to the handle 9 through the first stage 10.

The high-pressure hoses H1 to H4 pass through the inside of the handle 9 and are connected to the caps J8, J9, J6, Jx or the intake lever 6 through the inside of the shoulder parts 3.

The connection of the hoses will be described below in detail with reference to FIG. 7.

Referring to FIG. 6 for details, the first stage 10 is a member that functions as a joint connected with an attachment 50 and is attached to the air tank T such that the high-pressure hoses H1 to H4 are arranged in the same direction.

On the other hand, the handle 9 is provided as an inlet member that guides the high-pressure hoses H1 to H4 into the function-integrated portion 60.

Further, the handle 9 also functions as a rescue tool for holding a diver in an emergency.

When a diver with the diving equipment 100 according to the embodiment is in an emergency, the other diver who is a partner of the above diver (the diver with the diving equipment 100) rises to the surface of the water using the fins on both feet, holding the diver with the diving equipment 100 (the diver in the emergency) by holding the handle 9 at the back with one hand, thereby making it possible to rescue the diver with the diving equipment 100.

The rescuer injects air into his/her BCD the other's BCD (rescued-person) using the other hand that does not hold the handle 9 when reaching the surface of the water, to float on the water or be rescued by a rescue boat.

If the handle 9 is not provided, when the rescuer (e.g. a diver of the pair) approaches the front of the rescued-person (a diver in an emergency) for rescue, the rescued-person (the diver in the emergency) may hold the rescuer, such that not only the rescued-person, but the rescuer may be in a danger.

In this embodiment, as described above, it is possible for the rescuer to escape from a danger by holding the handle 9 of the rescued-person.

Referring to FIGS. 1, 3 and 5, the pressure resistant hose H8 is connected to the cap J8 and the regulator 11 is attached to an end of the pressure resistant hose H8.

The pressure resistant hose H9 is connected to the cap J9 and the gauge 12 is attached to an end of the pressure resistant hose H9.

The pressure resistant hose H6 is connected to the cap J6 and the octopus 13 is attached to an end of the pressure resistant hose H6.

Though not shown in detail in FIGS. 1, 3, and 5, the cap Jx is not connected with a hose and blocked by a plug in this embodiment.

In FIG. 1, a reference numeral '15' indicates weight bags (weight sacs) for balancing the left and right buoyancy and a reference numeral '16' indicates a weight suit.

Next, the connection of the intake hoses and exhaust hoses, and flow for intake and exhaust are described with reference to FIG. 7. In FIG. 7, the rear side is upside down with respect to the front side for better visual understanding.

Figure 7:
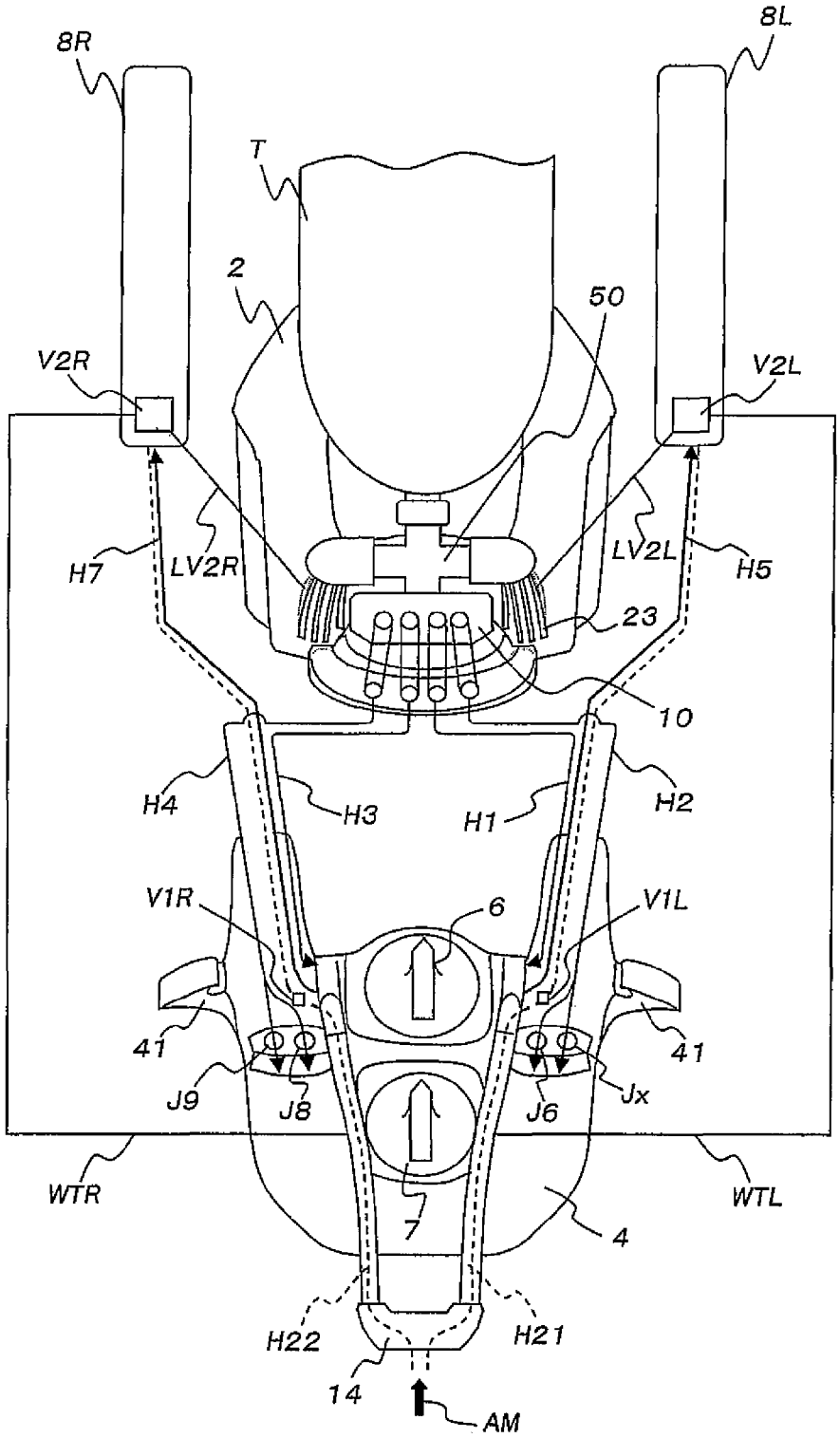
FIG. 7 is view illustrating a connection of intake and exhaust according to the embodiment of the invention.

Further, in order to prevent FIG. 7 from being complicated, detailed structure and reference numerals are not shown for the intake port for the right airbag, the intake port for the left airbag, the exhaust port for the right airbag, and the exhaust port for the left airbag of thoracoabdominal part 4 with the intake lever 6.

In FIG. 7, the pressure resistant hose H1 for the airbag disposed at the left side of the diver (the airbag shown at the right side in FIG. 7) is connected with the intake port for the left airbag of thoracoabdominal part 4 (the left airbag of the diver, that is, the airbag shown at the right side in FIG. 7) through the first stage 10, the handle 9, and the shoulder part 3 (not shown in FIG. 7) at the left side of the diver (at the right side in FIG. 1).

Further, the exhaust port for the left airbag of thoracoabdominal part 4 is connected with the left airbag 8L (the airbag at the left of the diver, that is, the airbag shown at the right side in FIG. 7) through the intake line (intake hose H5), which is a pressure resistant hose, and the inside of the shoulder part 3 (not shown in FIG. 7).

The pressure resistant hose H3 for the right airbag of the diver (the airbag shown at the left side in FIG. 7) is connected with the intake port for the right airbag of thoracoabdominal part 4 (the airbag at the right of the diver, that is, the airbag shown at the left side in FIG. 7) through the first stage 10, the handle 9, and the shoulder part 3 (not shown in FIG. 7) at the right side of the diver (the left side in FIG. 1).

The exhaust port for the right airbag of thoracoabdominal part 4 is connected with the right airbag 8R (the airbag at the right side of the diver, that is, the airbag shown at the left side in FIG. 7) through the intake line (intake hose H7), which is a pressure resistant hose, and the inside of the shoulder part 3 (not shown in FIG. 7).

The hose H21 for the left airbag connected with the oral inflator 14 is connected with the pressure resistant hose H5 through a check valve V1L and connected with the left airbag 8L. In order to show air flow in FIG. 7, the hose 21 and the hose H5 are arranged in a row, but the hose H21 is substantially connected with the hose H5 as described above.

Further, the hose H22 for the right airbag connected with the oral inflator 14 is connected with the pressure resistant hose H7 through a check valve V1R and connected with the right airbag 8R. In order to show air flow in FIG. 7, the hose H22 and the hose H7 are arranged in a row, but the hose H22 is substantially connected with the hose H7. Both of the hose H21 and the hose H22 are pressure resistant hoses.

The left airbag 8L is provided with an exhaust valve V2L and the outlet of the exhaust valve V2L is connected to the exhaust port 23. In FIG. 7, the connection of the outlet of the exhaust valve V2L with the exhaust port 23 is achieved by the connection of the exhaust valve V2L and the exhaust port 23 with the line LV2L.

Similarly, the left airbag 8R is provided with an exhaust valve V2R and the outlet of the exhaust valve V2R is connected with the exhaust port 23. In FIG. 7, the connection of the outlet of the exhaust valve V2L with the exhaust port 23 is achieved by a line LV2R.

The opening amount of the exhaust valve V2L connected with the left airbag 8L is adjusted by the exhaust lever 7 connected with a wire WTL for adjusting the opening amount of the exhaust valve. That is, the amount of exhaust from the left airbag 8L is determined by adjusting the exhaust lever 7 to adjust the opening amount of the exhaust valve V2L through the wire WTL.

Similarly, the amount of exhaust from the right airbag 8R is determined by adjusting the exhaust lever 7 to adjust the opening amount of the exhaust valve V2R through the wire WTL.

In FIG. 7, the first stage 10 is connected with the caps J8, J9 through the pressure resistant hose H4 (though not shown in FIG. 7, see FIG. 5) and connected with the caps J6, Jx through the pressure resistant hose H2 (though not shown in FIG. 7, see FIG. 5).

Further, the pressure resistant hoses H4, H2 also pass through the left and right shoulder parts 3.

Referring to FIGS. 1 and 7, the hose H8 for the regulator 11 is connected with the cap J8 (see FIG. 5) and the cap J9 (see FIG. 5) is connected with the hose H9 for the gauge 12.

Further, the hose H6 for the octopus 13 is connected to the cap J6 (see FIG. 5) and the cap Jx (see FIG. 5) is blocked by a plug that is not shown.

Meanwhile, the relationships of the caps J8, J9, J6, Jx, the hoses H8, H9, H6, and the plug are not limited to this embodiment shown in the figures.

During the intake, the right airbag 8R (the airbag at the left side in FIG. 7) is exemplified in describing the air flow in exhaust.

First, the high-pressure air in the tank T flows to thoraco-abdominal part 4 with the intake lever 6 in the pressure resistant hose H3 through the attachment 50 and the first stage 10.

Figure 8:
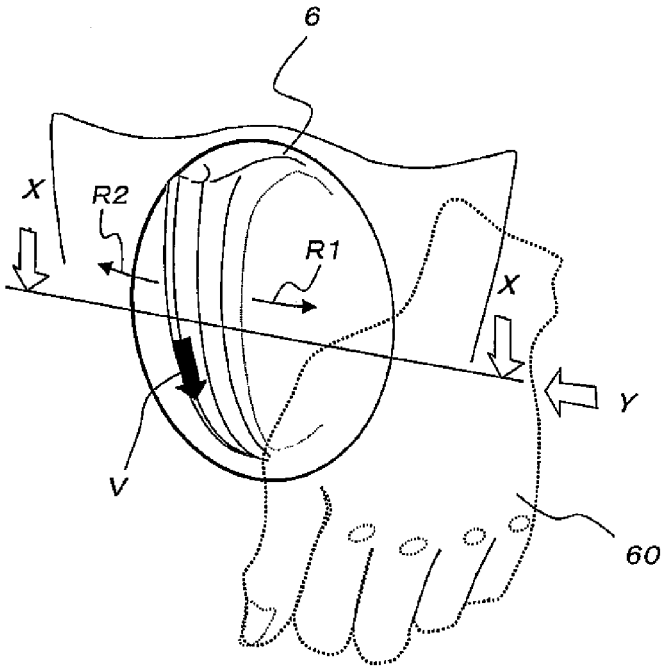
FIG. 8 is a perspective view illustrating an adjusting lever for intake according to the embodiment of the invention.
Figure 9:
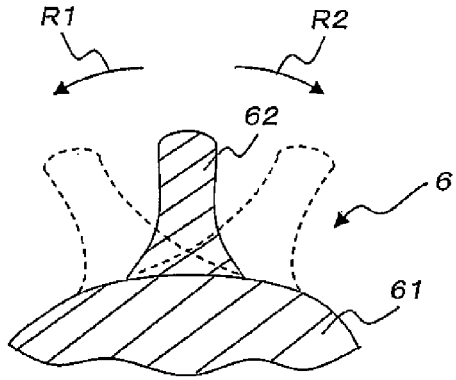
FIG. 9 is a cross-sectional view taken along the line X-X of FIG. 7.
Figure 10:
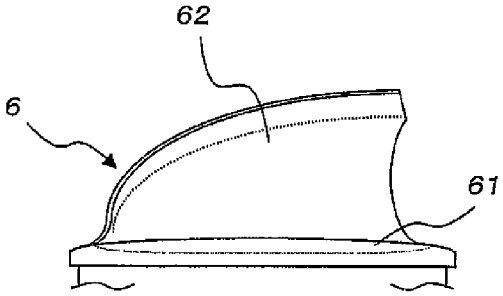
FIG. 10 is a view shown from the direction Y of FIG. 7.

The configuration of the intake lever 6 is described hereafter with reference to FIGS. 8 to 10.

The intake lever 6 is composed of a circular dial portion 61 (see FIGS. 9 and 10) and a plate-shaped protrusion (lever) 62 integrally formed at the center of the dial portion 61.

When operating the plate-shaped protrusion (lever) 62, it may be possible to move the lever 62 in any direction of arrow R1, arrow R2, and arrow V (see FIG. 8), pressing the lever 62 with the palm of the hand 60, without pulling the lever 62 using fingers of the hand.

As compared with operating the switch (button) using fingers in the related art, when the lever is operated as shown in FIGS. 8 to 10, it does not need to operate the lever using a finger tip, such that a diver having a problem with the finger tip or without fingers can easily operate the lever.

To fill the right airbag 8 with air, in FIG. 8, it is preferable to move the plate-shaped protrusion (lever) 62 of the intake lever 6 in the direction of arrow R2.

To fill the left airbag 8 with air, in FIG. 8, it is preferable to move the plate-shape protrusion (lever) 62 of the intake lever 6 in the direction of arrow R1.

Further, in order to simultaneously fill the left and right airbags 8L, 8R with air, it is preferable to press the plate-shaped protrusion (lever) 62 of the intake lever 6 in the direction of arrow V (down).

Though not show in detail, the operation of the exhaust lever 7 is the same as the intake lever 6.

For example, when the buoyancy at the right side is excessively large and the air needs to be removed from the right airbag 8R, the plate-shaped protrusion (lever) of the exhaust lever 7 is moved to the right of the diver. The movement of the plate-shaped protrusion (lever) of the exhaust lever 7 to the right of the diver is transmitted to the exhaust valve V2R through the wire WTR, which increases the opening amount of the exhaust valve V2R. As a result, the air in the right airbag 8R is discharged outside the equipment 100 from the exhaust outlet 23 through the exhaust valve V2R.

To inhale air into the mouth through the regulator 11, by inhalation, appropriate amount of air can be inhaled into the mouth from the tank T through the attachment 50, the first stage 10, the pressure resistant hose H4, the cap J8, and the hose H8 for the regulator.

The gauge 12 is connected with the inside of the tank T through the hose H9 for the gauge, the cap J9, the pressure resistant hose H4, the first stage 10, and the attachment 50, to show the pressure. Therefore, it is possible to always check the air pressure in the tank.

On the other hand, the inhalation passage for air through the octopus 13, that is, the air passage from the tank T to the octopus 13 is from the tank T to the octopus 13 through the attachment 50, the first stage 10, the pressure resistant hose H2, the cap J6, and the hose H6 for the octopus.

Further, it is preferable to hang unused hoses on the hose holder 41.

According to the embodiment of the invention having the above configuration, it is possible to achieve the following effects.

First, since the operating portion 5 with the intake lever 6 or the exhaust lever 7 is concentrated around the chest, a diver with a paralyzed arm can easily operate the operating portion.

Further, since various operations are made by the levers, a diver with a weak grip or a diver who has an amputated hand can also easily operate the operating portion.

Since the fixed ends of the hoses connected with the regulator 11, the gauge 12, the octopus 13, and the oral inflator 14 are concentrated to the chest, even if any one of the regulator 11, gauge 12, octopus 13, and oral inflator 14 moves to the diver's back, it is possible to return them by pulling them from the fixed ends of the hoses of the equipment that have moved to the back. Further, the easy return of the hose relieves the diver of his/her anxiety.

Since the left and right airbags 8L, 8R are separated, it is possible to balance the buoyancy by operating any one of the intake lever 6 and the exhaust lever 7 of the left and right airbags 8L, 8R. That is, it is possible to adjust the left/right buoyancy by supplying more air to the airbag at the side to increase the buoyancy or removing air from the airbag at the side to decrease the buoyancy. Further, as in the related art, the balance does not need to be adjusted by increasing the weight in the water.

Since the function-integrated member 60 has large rigidity and a stable shape, a diver can easily put on the function-integrated member 60 from above. Therefore, a person can put it on by himself/herself.

This is a first step for being able to independently diving for a disabled person, for example, who does not want unnecessary help.

Since the tank holding part 2 is short such that the lower end does not overlap the back of a wheelchair, it is possible for a diver with the tank to sit on the wheelchair. As a result, the diver can put on the equipment 100 on land and dive, such that not only the disabled person can lessen a burden of himself/herself, but lessen a burden on the supporter as well.

Since the large rigid handle 9 with a pipe clamp is provided, for example, even if one of a pair of divers has a problem such that he/she loses consciousness, the other diver can rise to the surface of the water, holding the handle 9 of the unconscious diver from the back with one hand.

Further, even if a healthy person handles the BCD according to an embodiment of the invention, the handles can also be used for carrying or holding.

Further, it is possible to arrange the pressure resistant hoses using the hose holder by disposing the hose holder 41 to the left and right sides of the operating portion 5. As a result, the diver is not interfered in various motions by the pressure resistant hoses, such that a diver with a problem in various motions can make any motion in the water as well as on the land.

Since the airbags 8L, 8R covers the entire sides of the femoral region of the human body, as compared with a BCD in the related art, which is disposed over the waist, it is easy to maintain the appropriate horizontal position of the entire body of the diver for diving.

The embodiment shown in the figures is an example of the invention and does not limit the technical aspect of the invention.

The invention claimed is:

1. Diving equipment, for a diver, having a function to hold a tank filled with compressed air on the shoulder of a wearer, and a function as a life jacket providing buoyancy to the wearer, and an overall vest shape, the diving equipment comprising:

a rigid structural member, further including a tank holding part, shoulders portions that divide into two portions on the shoulders of the diver, and a central portion of the structural member positioned at the center of the diver's thoracoabdominal region, wherein the tank holding part, the shoulders portions, and the central portion are formed continuous with each other;

an operating portion that is positioned at the center of the diver's thoracoabdominal region;

a handle, that is made of a rigid material, included in the tank holding part; and pressure resistant hoses, through which the air flows from the tank, being connected with the inside of the handle through a first stage and extending forward to the diver's thoracoabdominal region through an inner space, the inner space including an inner space of the tank holding part, an inner space of the shoulders portions, which are divided into the two portions, and an inner space of the central portion positioned at the center of the diver's thoracoabdominal region.

2. The diving equipment according to claim 1, wherein the operating portion comprises a lever-shape member that is movable to the left/right and downward.

3. The diving equipment according to claim 1, wherein the pressure resistant hoses through which air flows from the tank extend forward from the central portion positioned at the center of the diver's thoracoabdominal region.

4. The diving equipment according to claim 1, comprising regions where air stays that are provided at the left and right sides of the rigid structural member and wherein the regions where air stays are independently formed.

5. The diving equipment according to claim 1, comprising a holding portion that engages the pressure resistant hoses through which the air flows from the tank that is formed at the portion positioned at the center of the diver's thoracoabdominal region.

6. The diving equipment according to claim 1, wherein the tank holding part forms a gap between the tank and the diving equipment when holding the tank.

* * * * *